US007350645B1

(12) United States Patent
Sills

(10) Patent No.: US 7,350,645 B1
(45) Date of Patent: Apr. 1, 2008

(54) PRODUCT SECURITY SYSTEM FOR HANGING MERCHANDISE

(76) Inventor: Stephen Sills, 2100 Worthington Woods Blvd., Powell, OH (US) 43065

( * ) Notice: Subject to any disclaimer, the term of this patent is extended or adjusted under 35 U.S.C. 154(b) by 330 days.

(21) Appl. No.: 11/065,993

(22) Filed: Feb. 24, 2005

(51) Int. Cl.
*B65D 73/00* (2006.01)

(52) U.S. Cl. ..... 206/461; 206/806

(58) Field of Classification Search ..... 206/461–471, 206/806
See application file for complete search history.

(56) References Cited

U.S. PATENT DOCUMENTS

| | | | | |
|---|---|---|---|---|
| 3,939,979 | A * | 2/1976 | Neumayer | 206/461 |
| 4,456,122 | A * | 6/1984 | Kalal | 206/466 |
| 4,542,827 | A * | 9/1985 | Pilzer | 206/806 |
| 4,601,417 | A * | 7/1986 | Kunreuther | 206/806 |
| 4,821,437 | A | 4/1989 | Abramson et al. | 40/658 |
| 5,222,608 | A | 6/1993 | Eklof et al. | 211/54.1 |
| 5,267,643 | A * | 12/1993 | Scribner | 206/806 |
| 5,437,172 | A | 8/1995 | Lamy et al. | 70/57.1 |
| 5,509,528 | A | 4/1996 | Weisburn | 206/45.24 |
| 5,624,040 | A | 4/1997 | Hono | 211/4 |
| 5,636,821 | A | 6/1997 | Davies | 248/300 |
| 5,823,341 | A | 10/1998 | Nakasuji | 206/387.11 |
| 5,848,710 | A | 12/1998 | Pomper | 211/85.2 |
| 5,899,329 | A | 5/1999 | Hu et al. | 206/376 |
| 5,918,213 | A | 6/1999 | Bernard et al. | 705/26 |
| 5,944,177 | A * | 8/1999 | Nemoto | 206/468 |
| 6,070,721 | A | 6/2000 | Levitan | 206/308.1 |
| 6,199,309 | B1 | 3/2001 | Markarian | 40/299.01 |
| 6,206,189 | B1 | 3/2001 | Huot, Jr. et al. | 206/379 |
| 6,380,855 | B1 | 4/2002 | Ott | 340/568.2 |
| 6,539,280 | B1 | 3/2003 | Valiulis et al. | 700/236 |
| 6,543,261 | B2 | 4/2003 | Kolton et al. | 70/57.1 |
| 6,571,944 | B2 | 6/2003 | Ku | 206/308.1 |
| 6,595,355 | B1 * | 7/2003 | Hooper | 206/461 |
| 6,648,132 | B1 | 11/2003 | Smouha | 206/6.1 |
| 6,659,291 | B2 | 12/2003 | Huehner et al. | 211/4 |
| 6,694,653 | B2 | 2/2004 | Bradfield et al. | 40/642.01 |
| 6,719,133 | B2 | 4/2004 | Perez et al. | 206/308.2 |
| 6,729,469 | B1 | 5/2004 | Yau et al. | 206/308.1 |
| 6,848,285 | B2 | 2/2005 | Stroh | 70/57.1 |
| 6,857,527 | B2 | 2/2005 | Hu | 211/70.6 |

* cited by examiner

*Primary Examiner*—Luan K Bui
(74) *Attorney, Agent, or Firm*—Roger A. Gilcrest

(57) ABSTRACT

The present invention is a security system for preventing theft of hanging merchandise. The present invention includes a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removeably fit over the top portion of the product package and having apertures in the front and rear portions that are positioned so as to align with the aperture of the top portion when in position over the top portion.

11 Claims, 3 Drawing Sheets

PRODUCT SECURITY SYSTEM FOR HANGING MERCHANDISE

TECHNICAL FIELD FOR THE INVENTION

The present invention relates to a security system and a method of securing a merchandising package to a hang support.

BACKGROUND OF THE INVENTION

Today in nearly every store, transparent merchandise containers are used for packaging and merchandising almost any item imaginable, such as audio and video cassettes, electronic devices and components, watches, and other high value items.

Thermoformed containers of this type have the advantage of being produced in a wide variety of shapes and sizes to form a different sized container for each type of product to be packaged.

Such transparent plastic merchandise containers are typically produced using relatively thin molded plastic that is thick enough to contain and protect the item from the environment, but not so thick that it cannot be readily cut open by the consumer once purchase. One obvious advantage is that transparent plastic merchandise containers allow the consumer to view the contents without having to open the container. Other advantages of such transparent merchandise containers include the fact that they are lightweight, sturdy, easily arranged, and provide a high quality attractive appearance. It is naturally desirable to be able to produce these packages using an economic amount of plastic as the packages with be disposed of after being opened by the consumer.

In merchandising one or more of such transparent merchandise containers in stores, such transparent merchandise containers are typically suspended from merchandise racks. To facilitate such suspension, the containers are usually provided with an upstanding side wall extension or hanging flange having an opening therein to allow the container to hang from a merchandising hook.

With transparent plastic merchandise containers, it is also important to the packager that they discourage theft. Typically, these packages are hung in a series on long merchandise display hooks. The packages normally are provided with an aperture through which the display hook extends. For high value items, the long merchandise display hooks are in turn provided with locking mechanisms at the front end of the hook to prevent the items from being removed without the assistance of the store keeper.

However, the typical thickness of the transparent merchandise packaging allows them to be sliced at a position near the hang aperture, allowing the entire package to be removed from a locked merchandise hook.

One of the approaches used to discourage theft of hung items is to provide a separate transparent container of a thick plastic which also has a thick hanger portion. These containers are used for displaying the merchandise, but are reused by the store keeper by removing them from around the packaged product once purchased. Such a container is disclosed in U.S. Pat. No. 5,509,528, which is hereby incorporated herein by reference. However, this approach involves the need to provide a complete set of these outer packages which must be in an array of sizes it they are to protect a wide variety of merchandise. This requires a substantial investment and the provision of additional storage for these temporary containers.

Accordingly, in light of the aforementioned shortcomings of currently available merchandise containers, there has been a long-felt need to provide an improved transparent plastic merchandise container system that is capable of convenient and effective use to prevent theft while being relatively less expensive than known systems, and which may be applied with a relatively small investment in additional equipment.

SUMMARY OF THE INVENTION

The present invention includes a security system for preventing theft of hanging merchandise. The present invention includes security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removeably fit over the top portion of the product package and having apertures in the front and rear portions that are positioned so as to align with the aperture of the top portion when in position over the top portion.

The protective member may be formed so as to form the front and rear portion thereof and a top portion thereof, such as by a single bend in a plastic member, by two right angle bends in a plastic member or by a right angle bend in a plastic member and an acute angle bend in a plastic member.

It is preferred that the width of the product package the width of the protective member are substantially the same.

It is also preferred that the protective member is transparent.

The present invention also includes a method of securing a hanging product package against theft, the method comprising the steps: (a) obtaining a product package of a relatively thin plastic material and having a top portion, the top portion having an aperture adapted to receive a hang support; (b) positioning a protective member of a relatively thick plastic material over the top portion, the protective member adapted to removeably fit over the top portion and having an aperture that is positioned so as to align with the aperture of the top portion when in position over the top portion; and (c) placing a hang support member through the apertures. It is also preferred that the support member have a locking mechanism to lock the end of the support member, such as a locking hook system.

The invention also includes a security package system for a product to be placed on a hanging display, the package comprising: (a) a product package of a relatively thin plastic material and having a top portion which has a front and rear, and which has a relatively wide portion and a relatively narrow portion, the relatively narrow portion having a width and having an aperture adapted to receive a hang support; and (b) a protective member of a relatively thick plastic material and having a front and rear portion so as to removeably fit over the top portion and having a width substantially the same as that of the narrow portion, and apertures in the front and rear portions that are positioned so as to align with the aperture of the top portion when in position over the top portion. It is also preferred that the support member have a locking mechanism to lock the end of the support member, such as a locking hook system as are known and used in the art.

The invention also includes a method of securing a hanging product package against theft, the method comprising the steps: (a) obtaining a product package of a relatively thin plastic material and having a top portion which has a front and rear, and which has a relatively wide portion and a relatively narrow portion, the relatively narrow portion having a width and having an aperture adapted to receive a hang support; and (b) positioning a protective member of a relatively thick plastic material over the narrow portion, protective member of a relatively thick plastic material and having a front and rear portion so as to removeably fit over the top portion and having a width substantially the same as that of the narrow portion, and apertures in the front and rear portions that are positioned so as to align with the aperture of the top portion when in position over the top portion; and (c) placing a hang support member through the apertures. It is also preferred that the hang support member be the locked to prevent unauthorized removal of the combination product package and protective member from the hang support member.

DETAILED DESCRIPTION OF THE PREFERRED EMBODIMENTS

In accordance with the foregoing summary of the invention, the following presents the preferred embodiments of the present invention, which are considered to be the best mode thereof.

Figure 1:
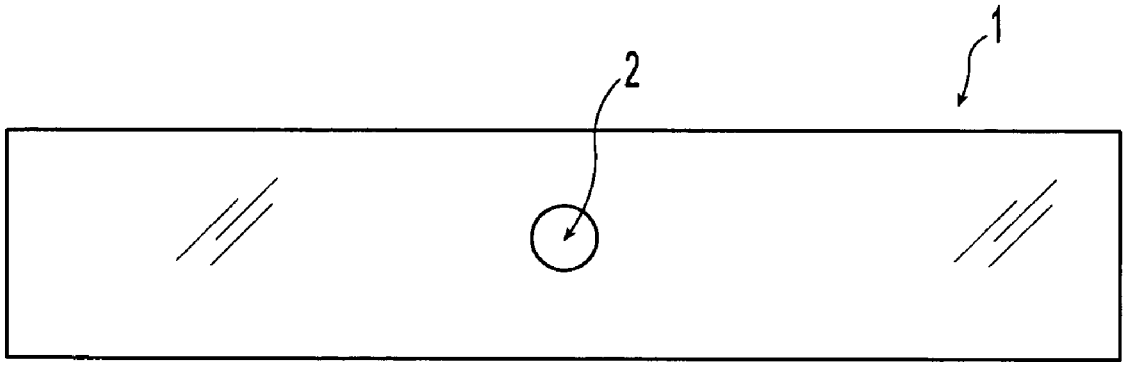
FIG. 1 is an elevational frontal view of a product package protective member that forms a part of the product security system in accordance with one embodiment of the present invention.

FIG. 1 is an elevation frontal view of a product package protective member 1 that forms a part of the product security system in accordance with one embodiment of the present invention. FIG. 1 shows aperture 2 that preferably is centrally disposed along the horizontal axis. As will be appreciated from the following Figures, it is also preferred that the aperture be disposed so as to restrict access to the portion of the package through which the hanging aperture is placed, once hung therefrom.

Figure 2:
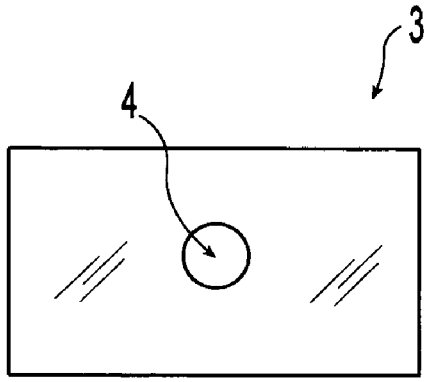
FIG. 2 is an elevational frontal view of a product package protective member that forms a part of the product security system in accordance with another embodiment of the present invention.

FIG. 2 is an elevation frontal view of a product package protective member 3 that forms a part of the product security system in accordance with another embodiment of the present invention. FIG. 2 shows aperture 4 that preferably is centrally disposed along the horizontal axis.

Figure 3:
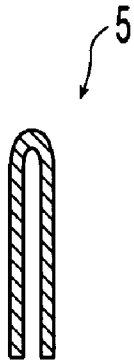
FIGS. 3, 4 and 5 are 1 is an elevational side view of a product package protective members that form a part of the product security system in accordance with three embodiments of the present invention, and showing different cross-section geometry.
Figure 4:
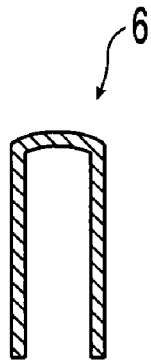
Figure 5:
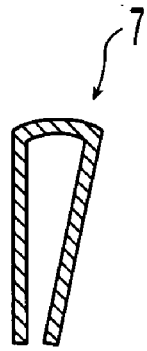

FIGS. 3, 4 and 5 are elevation side views respectively of product package protective members 5, 6 and 7 that form a part of the product security system in accordance with three embodiments of the present invention, and showing different cross-section geometry. Protective member 5 shows a simple arcuate cross-section, while protective member 6 features two angles of approximately 90 degrees, and protective member shows the cross-section having one angle of approximately 90 degrees, and another of more than 90 degrees to provide a closer engagement with the product package as will be appreciated in FIGS. 6-8. The materials from which the package protective members may be made include plastic materials such as PVC, other vinyl plastics, acrylics or other relatively hard plastics that resist cutting or fracture, with acrylics being preferred. Typical preferred thicknesses are in the range of from about 0.09 to about 0.12 inches.

Figure 6:
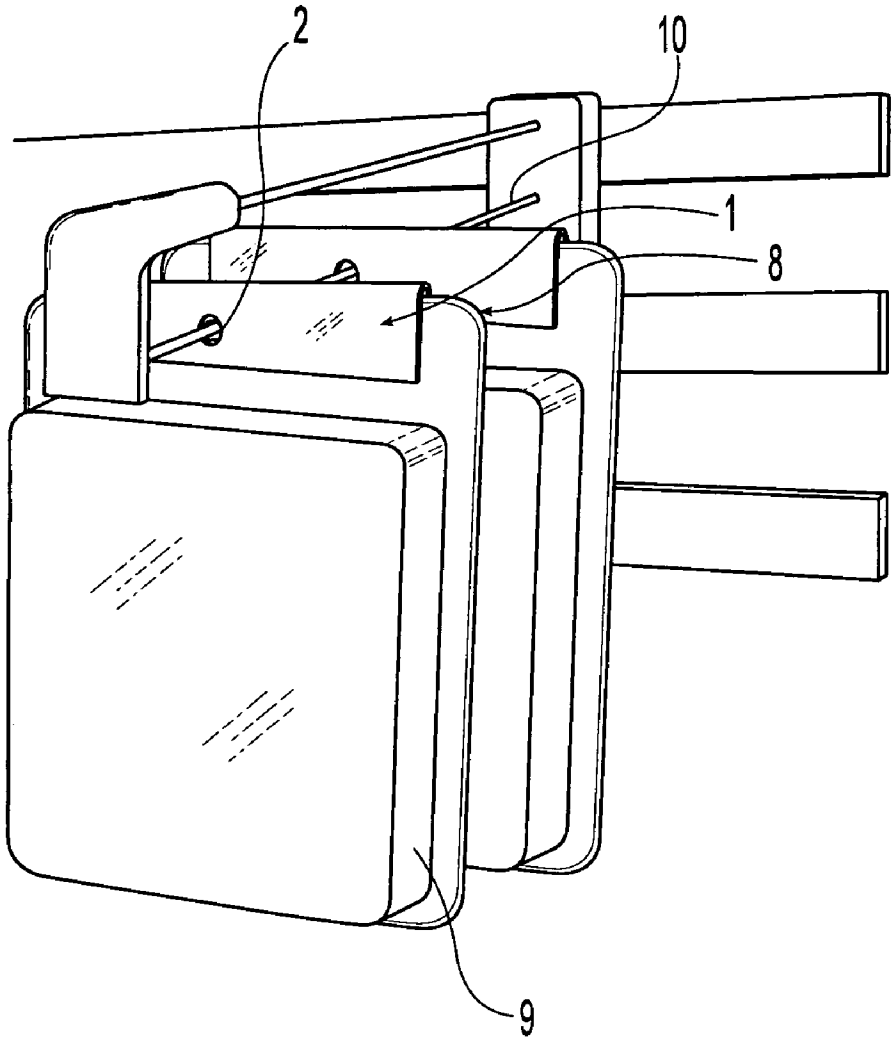
FIG. 6 is a perspective view of an assembled product security system in accordance with one embodiment of the present invention.

FIG. 6 is a perspective view of an assembled product security system in accordance with one embodiment of the present invention. FIG. 6 shows product package protective member 1 placed over the upper edge 8 of product package 9 that hangs from locked security hook 10 that forms a part of the product security system in accordance with one embodiment of the present invention. FIG. 1 shows aperture 2 that preferably is centrally disposed along the horizontal axis.

Figure 7:
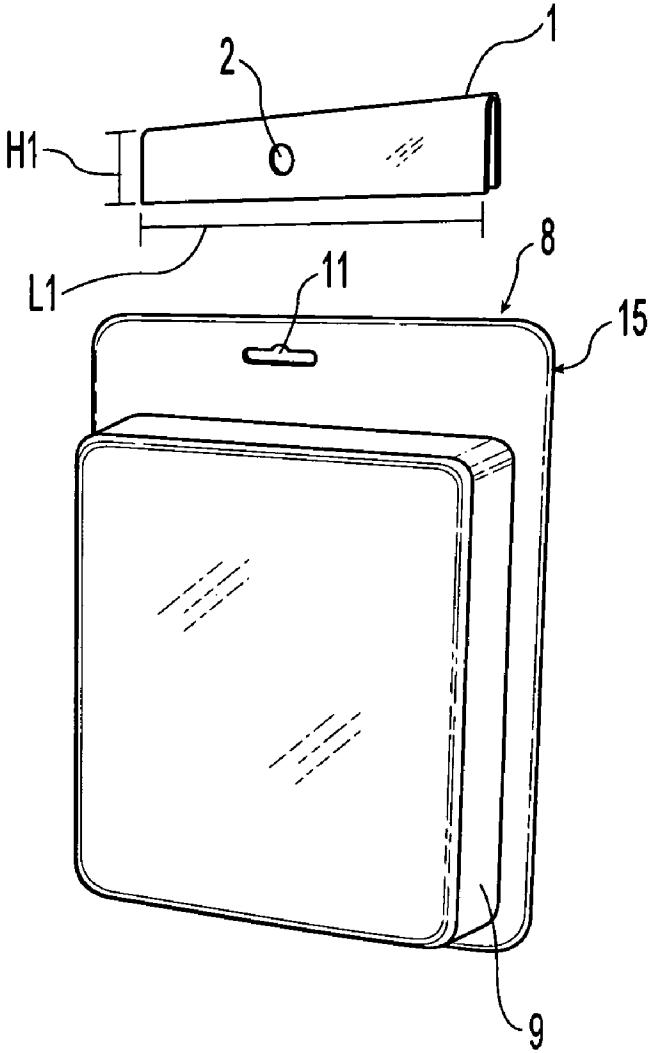
FIG. 7 is an exploded perspective view of a package and a product package protective member forming part of a product security system in accordance with one embodiment of the present invention.

FIG. 7 is an exploded perspective view of a package and a product package protective member forming part of a product security system shown in FIG. 6. This view shows package protective member 1 in position to be placed over the upper edge 8 of product package 9 prior to it being placed upon locked security hook 10 as shown in FIG. 6. The product package 9 is provided with an aperture 11 as part of the product package design. It will be noted that the package protective member 1 is of sufficient size in terms of length and height, such that the region of the upper edge 9 of the product package, and its aperture 11, are protected from being cut by a knife or other tool. Naturally, it is preferred that the package protective member 1 be sufficient length L1 to cover most if not all of the upper edge 8 of product package 9. It is also preferred that the package protective member 1 be sufficient height H1 to extend substantially below the level at which the aperture 11 is placed in the upper edge 8 of product package 9.

It is preferred that aperture 2 should be sufficiently small such that the protective member cannot be shifted either horizontally or vertically so as to expose the region of the upper edge 9 of the product package containing aperture 11 to being cut or otherwise destroyed.

In addition, it will be appreciated that some product packages have lipped areas along their lateral edges, such as lip 15. With these package designs, it is preferred that the package protective member have a pinched cross-section geometry, such as that shown in FIG. 5, so that the front and rear portions of package protective member are at a distance less than the thickness of the lipped portion of the lateral edge, to further resist movement of the package protective member with respect to the product package.

Figure 9:
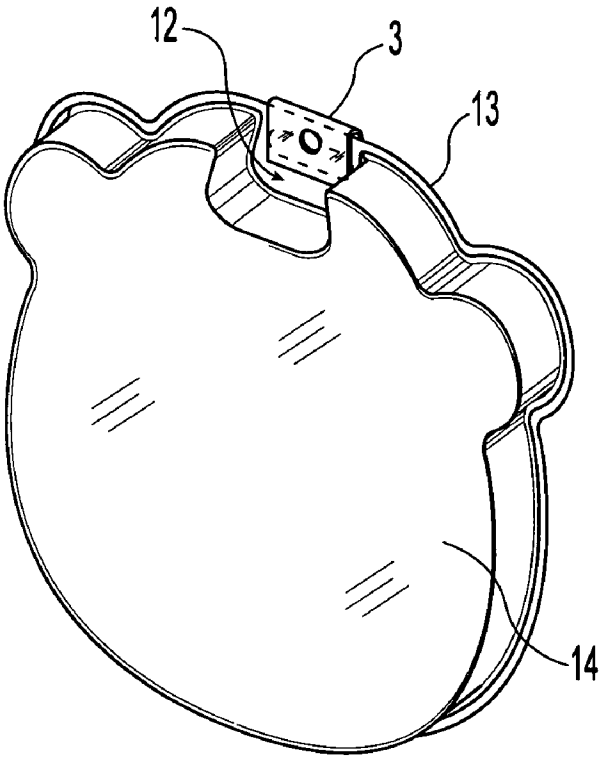
FIG. 9 is a perspective view of a package and a product package protective member forming part of a product security system in accordance with another embodiment of the present invention.
Figure 8:
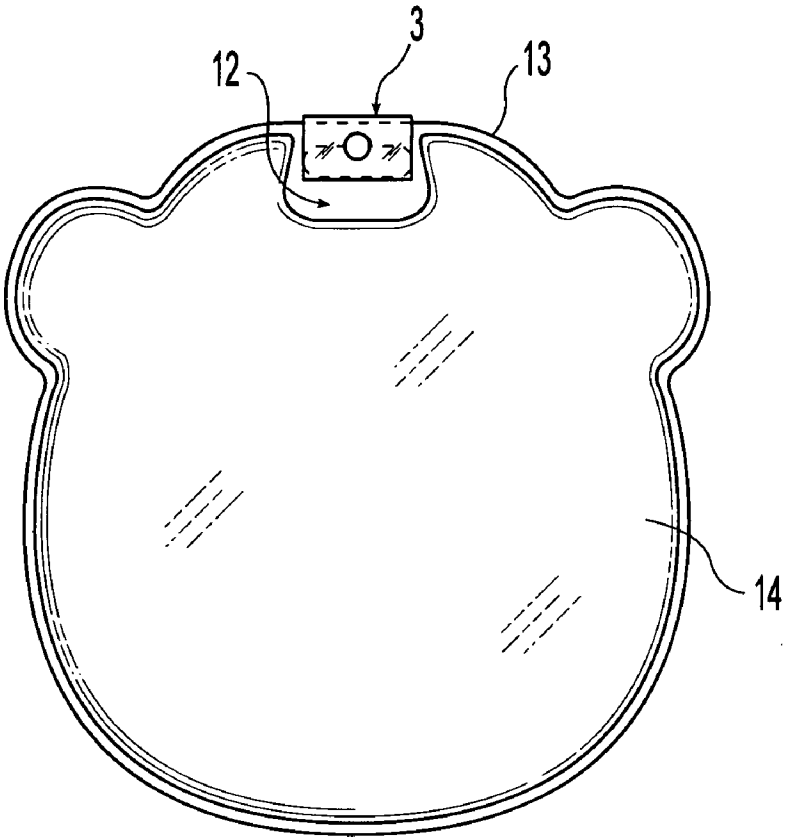
FIG. 8 is an elevational view of a package and a product package protective member forming part of a product security system in accordance with another embodiment of the present invention.

FIGS. 8 and 9 are views of a package and a product package protective member forming part of a product security system in accordance with another embodiment of the present invention. This embodiment operates in substantially the same way as the embodiment shown in FIGS. 6 and 7. These Figures show package protective member 3 in position to be placed over the upper edge 13 of product package 14 prior to it being placed upon a locked security hook such as is shown in FIG. 6. The product package 14 is provided with an aperture in much the same fashion as shown in FIG. 7 as part of the product package design.

This embodiment however takes advantage of the difference in thickness in sections of the upper edge 13. As can best be appreciated from FIG. 9, product package 14 has a relatively thin portion through which the hanging aperture is provided, which creates well area 12. The package protective member 3 is of sufficient size in terms of length and height, such that the region of the upper edge 13 of the product package, and its aperture, are protected from being cut by a knife or other tool. Naturally, it is preferred that the package protective member 3 be sufficient length to cover most if not all of the upper edge 13 of product package 14. It is also preferred that the package protective member 3 be sufficient height to extend substantially below the level at which the aperture is placed in the upper edge 13 of product package 14. This embodiment takes advantage of the interfering arrangement between the package protective member 3 and the relatively thick portion of the upper edge 13 of product package 14, in order to prevent the package protective member 3 from being moved from its position protecting the relatively vulnerable aperture-bearing relatively thin portion of the upper edge 13 of product package 14.

In practice, the protective member is placed over the product package as shown for example in FIGS. 8 and 9. The hang support is then passed through the commonly aligned apertures in the protective member and the product package. The hang member, such as a lockable support hook may then be lock to secure the package, as shown in FIG. 6.

In some instances, the product package will be asymmetrical and the hang aperture of the product package will be off-center such that the product package hangs vertically from a point over its center of gravity. In these cases, the aperture on the product package protective member may likewise be disposed off-center so as to be aligned with the hang aperture of the product package.

Some of the advantages of the present invention are that the products are protected from easy pilferage while not involving a large investment in protective boxes that would have to be provided in several sizes. Security devices of this type also have the disadvantage that they are constructed of thick plastic which becomes marred through repeated use. The present invention maintains the advantage of the clarity and convenience of a wide range of original product packages while allowing these packages to be protected from theft with the use of only a few sizes of protective members. The protective members used in accordance with the present invention may be recycled for use as the packaged product is sold and restocked. This prevents the manufacturer from having to invest more in the original equipment packaging itself to prevent or discourage theft.

They may be made of transparent plastic to maintain the visibility of the entire original package presentation.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

What is claimed is:

1. A security package system for a product to be placed on a hanging display having a hang support member having a receiving end, said package comprising:

(a) a product package of a relatively thin plastic material and having a top portion which has a front and rear, said top portion having an aperture adapted to receive said hang support member, said aperture placed such that said product package cannot be removed from said hang support member without being moved over said receiving end;

(b) a protective member of a relatively thick plastic material and having a front and rear portion so as to removably fit over said top portion and having apertures in said front and rear portions adapted to receive said hang support member and that are positioned so as to align with said aperture of said top portion when in position over said top portion, and said apertures placed such that said protective member cannot be removed from said hang support member without being moved over said receiving end; and (c) a hang support member adapted to be removably extended through said apertures, and a lock adapted to prevent unauthorized removal of said protective member and said product package from said hang support member.

2. A security package system according to claim 1 wherein said protective member is formed by a single bend in a plastic member.

3. A security package system according to claim 1 wherein said protective member is formed by two right angle bends in a plastic member, so as to form said front and rear portion thereof and a top portion thereof.

4. A security package system according to claim 1 wherein said protective member is formed by right angle bend in a plastic member and an acute angle bend in a plastic member, so as to form said front and rear portion thereof and a top portion thereof.

5. A security package system according to claim 1 wherein said product package has a width and said protective member has a width, and wherein said widths are substantially the same.

6. A security package system according to claim 1 wherein said protective member is transparent.

7. A security package system for a product to be placed on a hanging display having a hang support member having a receiving end, said package comprising:

(a) a product package of a relatively thin plastic material and having a top portion which has a front and rear, and which has a relatively wide portion and a relatively narrow portion, said relatively narrow portion having a width and having an aperture adapted to receive said hang support member, said aperture placed such that said product package cannot be removed from said hang support member without being moved over said receiving end; and (b) a protective member of a relatively thick plastic material and having a front and rear portion so as to removably fit over said top portion and having a width substantially the same as that of said narrow portion, and apertures in said front and rear portions adapted to receive said hang support member and that are positioned so as to align with said aperture of said top portion when in position over said top portion, and said apertures placed such that said protective member cannot be removed from said hang support member without being moved over said receiving end; and (c) a hang support member adapted to be removably extended through said apertures, and a lock adapted to prevent unauthorized removal of said protective member and said product package from said hang support member.

8. A security package system according to claim 7 wherein said protective member is formed by a single bend in a plastic member.

9. A security package system according to claim 7 wherein said protective member is formed by two right angle bends in a plastic member, so as to form said front and rear portion thereof and a top portion thereof.

10. A security package system according to claim 7 wherein said protective member is formed by right angle bend in a plastic member and an acute angle bend in a plastic member, so as to form said front and rear portion thereof and a top portion thereof.

11. A security package system according to claim 7 wherein said protective member is transparent.

* * * * *